US011391119B2

(12) United States Patent
Parameshwaraiah et al.

(10) Patent No.: US 11,391,119 B2
(45) Date of Patent: Jul. 19, 2022

(54) DIFFERENTIAL FILL VALVE WITH COLLET SLEEVE

(71) Applicant: Halliburton Energy Services, Inc., Houston, TX (US)

(72) Inventors: Rajesh Parameshwaraiah, Houston, TX (US); Min Mark Yuan, Katy, TX (US); Saul Emmanuel Vazquez Niebla, Humble, TX (US); Lonnie Carl Helms, Humble, TX (US); Mayur Narain Ahuja, Friendswood, TX (US); Tor Sigve Saetre, Spring, TX (US); Kevin Ardoin, Montgomery, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 64 days.

(21) Appl. No.: 16/994,256

(22) Filed: Oct. 23, 2020

(65) Prior Publication Data

US 2022/0127930 A1 Apr. 28, 2022

(51) Int. Cl.

| | |
|---|---|
| ***E21B 34/12*** | (2006.01) |
| ***E21B 34/06*** | (2006.01) |
| ***E21B 34/14*** | (2006.01) |

(52) U.S. Cl.

CPC ..... *E21B 34/12* (2013.01); *E21B 34/063* (2013.01); *E21B 34/14* (2013.01); *E21B 2200/05* (2020.05)

(58) Field of Classification Search

CPC ..... E21B 34/12; E21B 34/063; E21B 34/14; E21B 2200/05; E21B 34/142; E21B 33/14; E21B 23/0413

See application file for complete search history.

(56) References Cited

U.S. PATENT DOCUMENTS

| | | | | |
|---|---|---|---|---|
| 3,275,080 | A * | 9/1966 | Nelson | E21B 21/10 166/239 |
| 4,474,241 | A * | 10/1984 | Freeman | E21B 21/10 137/71 |
| 4,729,432 | A | 3/1988 | Helms | |
| 5,960,881 | A * | 10/1999 | Allamon | E21B 33/05 166/70 |
| 8,955,543 | B2 | 2/2015 | Groesbeck et al. | |

(Continued)

FOREIGN PATENT DOCUMENTS

| | | |
|---|---|---|
| CN | 110173233 A | 8/2019 |
| EP | 2143875 A2 | 1/2010 |

(Continued)

OTHER PUBLICATIONS

International Search Report and Written Opinion dated Sep. 10, 2021, issued in PCT Application No. PCT/US2021/036587.

(Continued)

*Primary Examiner* — Michael R Wills, III
(74) *Attorney, Agent, or Firm* — McAfee & Taft

(57) ABSTRACT

A valve housing has a first flapper moveable from an open position in the housing in which two-way flow is allowed to a closed position in which only one-way flow is permitted. A first collet sleeve is moveable from a first position to a second position in the valve housing. The first collet sleeve in the first position retains the flapper valve in the open position. The collet sleeve is moveable from a first position to a second position which allows the flapper to move to a closed position.

20 Claims, 6 Drawing Sheets

(56) References Cited

U.S. PATENT DOCUMENTS

| | | | | |
|---|---|---|---|---|
| 9,482,073 | B2 | 11/2016 | Andrigo | |
| 9,708,894 | B2 * | 7/2017 | Ditzler | E21B 23/04 |
| 10,443,338 | B2 * | 10/2019 | Mailand | E21B 23/06 |
| 10,619,448 | B1 * | 4/2020 | Watson | E21B 34/063 |
| 2002/0033262 | A1 | 3/2002 | Musselwhite et al. | |
| 2004/0163820 | A1 | 8/2004 | Bishop et al. | |
| 2011/0198100 | A1 * | 8/2011 | Braekke | E21B 34/14 166/318 |
| 2011/0290344 | A1 | 12/2011 | Groesbeck et al. | |
| 2015/0136404 | A1 | 5/2015 | Groesbeck et al. | |
| 2017/0356270 | A1 | 12/2017 | Stair | |
| 2017/0370186 | A1 | 12/2017 | Stair | |
| 2018/0238460 | A1 | 8/2018 | Mericas et al. | |
| 2021/0372229 | A1 * | 12/2021 | Palmer | E21B 34/14 |

FOREIGN PATENT DOCUMENTS

| | | | |
|---|---|---|---|
| WO | 2016133539 | A1 | 8/2016 |
| WO | 2016133541 | A1 | 8/2016 |

OTHER PUBLICATIONS

International Search Report and Written Opinion dated Oct. 28, 2021, in corresponding PCT Application No. PCT/US2021/036771.

* cited by examiner

DIFFERENTIAL FILL VALVE WITH COLLET SLEEVE

BACKGROUND

In the oil and gas industry, wellbores are drilled into the surface of the earth to access reservoirs for the extraction of hydrocarbons. Wellbores are often lined with casing or a string of casing sections or lengths, and the casing is then secured into place using cement. In one cementing technique, a cement composition is pumped through the interior of the casing and allowed to flow back toward the surface via the annulus defined between the wellbore wall and the casing. Once the cement composition cures within the annulus to form a hardened mass, the casing serves to stabilize the walls of the surrounding subterranean formation to prevent any potential caving into the wellbore.

When casing is being run into a wellbore it is sometimes desirable to "float" the casing down to its intended location within the wellbore fluid prior to the time the casing is cemented in the well. It is also desirable to have the casing fill automatically at a predetermined rate.

Float valves are one-way valves (i.e., check valves) that can be installed at or near the interior bottom end of a casing string. Once operational, float valves permit fluid (such as mud or cement) to flow down through the inside of the casing, but prevent fluids from flowing in the reverse direction back up the inside of the casing. By doing so float valves prevent cement that is pumped down through the casing and into the annular space from flowing back up through the valves once the cement is in place.

Float shoes and float collars permit automatic filling of the casing and incorporate a backpressure valve to prevent cement back flow into the casing after the cementing operation. Certain backpressure valves also permit the option of terminating the filling of the casing at any point in time. During the insertion of casing into the wellbore, a traditional auto-fill, flapper-type float valve is held open by a pin set across a sleeve in the valve assembly bore. When it is desired to actuate the backpressure valve to prevent further filling of the casing a weighted tripping ball is dropped, or carried in with the float valve, which breaks the pin holding the sleeve and thereby freeing the flapper valve to close. After cementing has been completed, the released flapper valve prevents cement flow back into the casing from the wellbore annulus. Due to the close operating pressures of the float valve, premature release of the flapper valve can occur. Additionally, the same operating conditions can cause the flapper valve to not release entirely.

DESCRIPTION OF THE DRAWINGS

FIG. 6 is a cross-sectional view of a fill valve assembly with first and second flapper valves in a closed position after a tripping ball has passed therethrough.

DESCRIPTION OF AN EMBODIMENT

Figure 1:
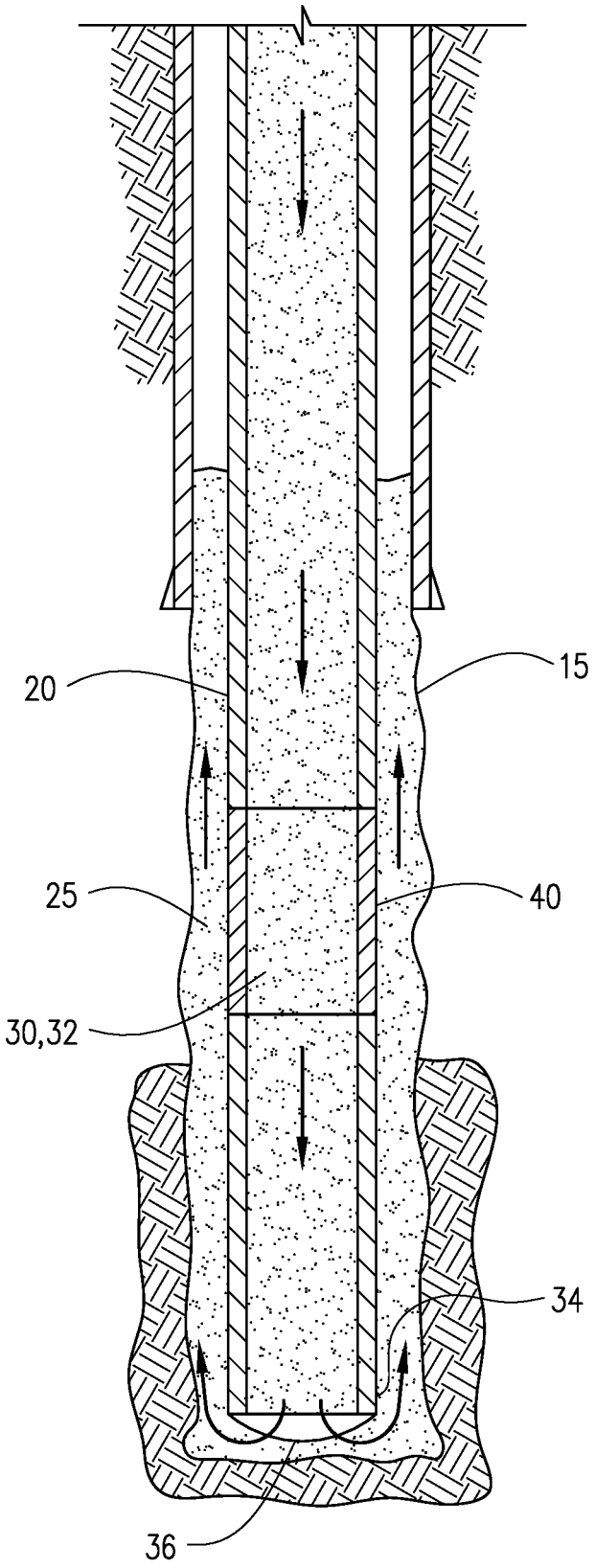
FIG. 1 illustrates a cross-sectional side view of a casing with the fill valve assembly disclosed therein.

Referring now to the figures a wellbore 15 is shown with a casing string 20 lowered therein. Casing string 20 and wellbore 15 define an annulus 25 therebetween. Casing string 20 will be lowered from a wellhead installation at the surface of the earth in a manner known in the art. A casing shoe 36 may be attached at or near the end of casing string 20. To secure the casing string 20 within wellbore 15 cement 30 is pumped therethrough until it passes out the bottom end 34 of casing string 20. A casing shoe 36 may be attached to bottom end 34. Cement will flow out of bottom end 34 through casing shoe 36 and will travel upwardly in annulus 25.

A fill valve assembly 50 may be provided within a float collar 40 of casing string 20. Float collar 40 may be connected at its upper end 46 to upper casing 42 and at its lower end 48 to lower casing 44. Fill valve assembly 50 is fixed in float collar 40 with a cementitious body 41. The fill valve assembly 50 is held firmly in place by the cementitious body 41. As is apparent from the drawings, fluid, for example cement 30 will be directed through fill valve assembly 50 as there is no path around fill valve assembly 50 through float collar 40.

Fill valve 50 has outer housing 52, and has upper end 54 and lower end 56 and a central flow passage 57 therethrough. Fill valve 50 comprises a first flapper valve 58 and a second flapper valve 60 connected thereto. A ball cage 64 is connected to the upper end 54 of the housing 52, which is the upper end of the fill valve assembly 50. Cage 64 comprises a retaining ring 66 and a crows nest 68. A tripping ball 70 is initially trapped between retaining ring 66 and crows nest 68. Retaining ring 66 defines a diameter 74 that is smaller than diameter 72 of tripping ball 70. Tripping ball 70 may comprise a phenolic tripping ball or other material such that upon the application of pressure tripping ball 70 will deform slightly and pass through the diameter 74 of retainer 66. Crows nest 68 has a space 78 between the feet 76 thereof that will not allow tripping ball 70 to pass upwardly therethrough.

First flapper valve 58 comprises first flapper valve housing 62 which forms a part of outer housing 52. First flapper valve housing 62 comprises an upper housing portion 82 and a lower housing portion 86. A flapper 80 is pivotally connected to upper housing portion 82 with a pivot pin 84 or other mechanism. Flapper 80 is biased with a spring or otherwise to move from the open position 102 to the closed position 106 which is shown in FIG. 6.

A lower housing portion 86 of first flapper valve 58 is connected to upper housing portion 82. Flapper 80 in the open position extends downwardly into lower housing portion 86 and is restrained in the open position by a first collet sleeve 88. First collet sleeve 88 is detachably connected in housing 52 and more specifically in lower housing portion 86 of first flapper valve housing 62. Collet sleeve 88 has upper end 90 and lower end 92. Collet sleeve 88 has a plurality of collet fingers 94 with radially inward facing collet heads 96 at the lower end 92 of collet sleeve 88. Collet head 96 defines a breakaway seat 98 which may be referred to as a first breakaway seat 98. Breakaway seat 98 has a diameter 100 which is smaller than diameter 72 of tripping ball 70.

Figure 2:
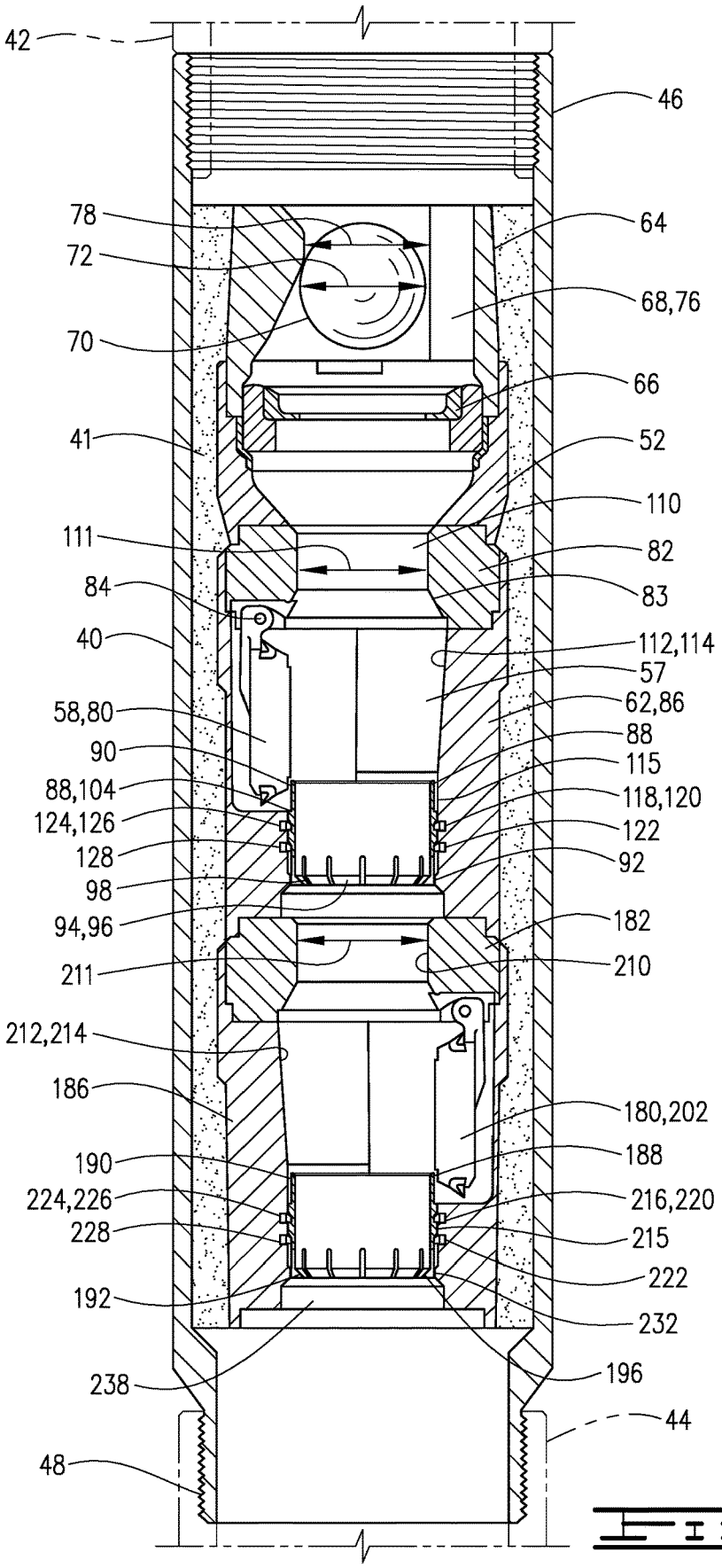
FIG. 2 is a cross-sectional view of a fill valve assembly of the current disclosure employed in a casing float collar.
Figure 3:
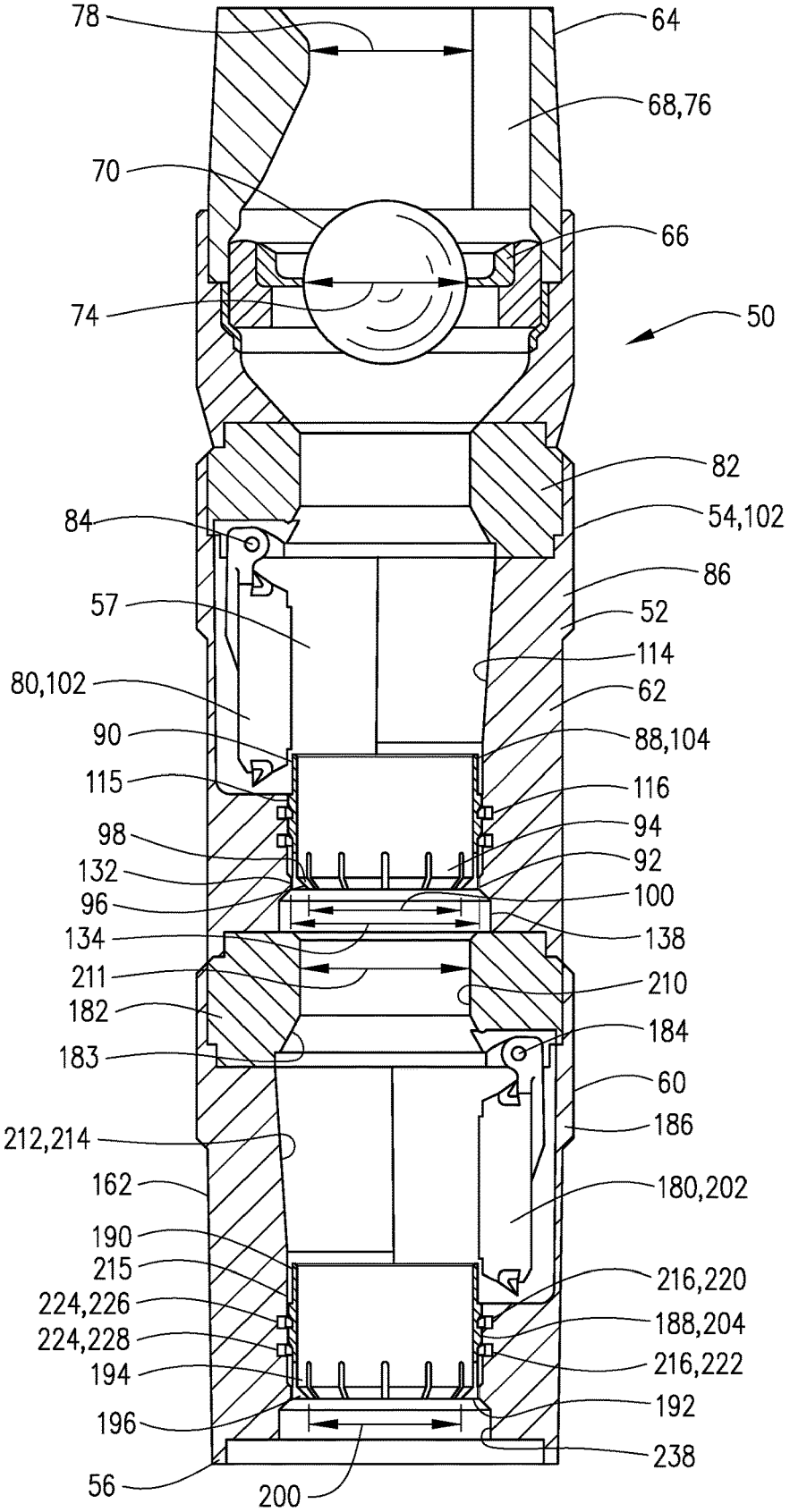
FIG. 3 is a cross-sectional view of a fill valve assembly in an open position with a tripping ball engaged with a retaining ring.
Figure 4:
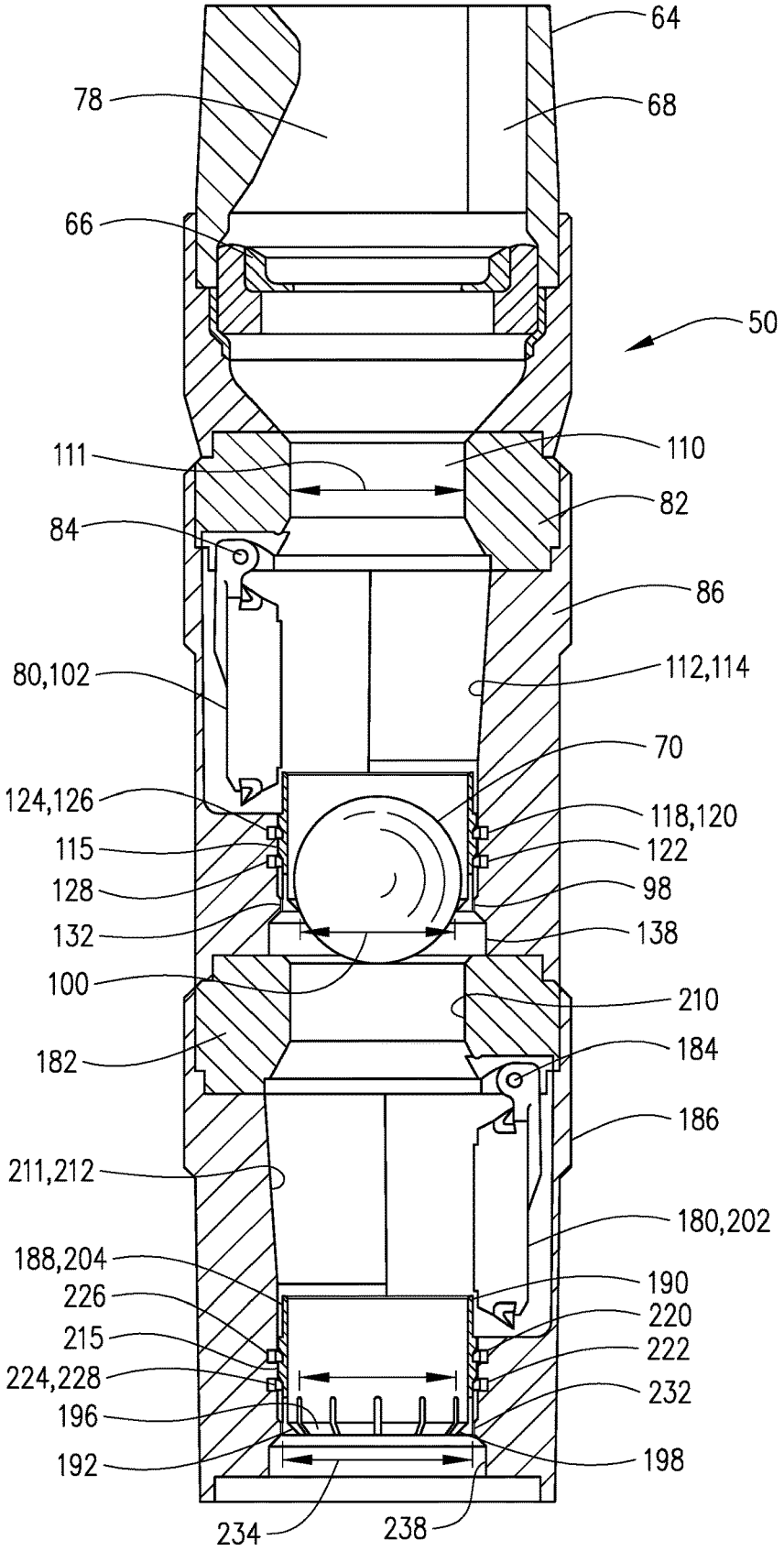
FIG. 4 is a cross-sectional view of a fill valve assembly with a tripping ball engaging a collet sleeve.

FIGS. 2-4 show the first position 104 of first collet sleeve 88 in which first collet sleeve 88 restrains flapper 80 in its open position 102. In the open position 102 two-way flow is permitted through the first flapper valve housing 62. Thus, fluid will flow through flapper valve 58 as casing 20 is lowered into the wellbore 15 to the desired location. The closed position 106 of flapper 80 is shown in FIG. 6. In the closed position 106 one-way flow only is allowed through first flapper valve 58. Thus, cement can flow downwardly therethrough but upward flow is prevented by flapper valve 58 and specifically by flapper 80 which is biased towards upper housing 82 in which the closed position 106 will engage a seat 83 defined on upper housing portion 82 to prevent upward flow therethrough. Flapper 80 moves to the closed position 106 when first collet sleeve 88 is detached from first flapper valve housing 62 and moves downwardly to its second position 108.

Upper housing portion 82 has a bore 110 with a diameter 111 that is large enough to allow tripping ball 70 to pass therethrough. Housing 52 has a bore 112 and specifically lower housing portion 86 of first flapper valve housing 62 has a bore 112 that extends radially outwardly from bore 110. Bore 112 has a first portion 114 and a second portion 115 below first portion 114. Second portion 115 is a generally cylindrical portion. Second portion 115 has at least one groove 116 therein. The at least one groove 116 comprises a first pair of grooves 118. The pair of first grooves 118 comprises a first upper groove 120 and a first lower groove 122.

At least one lock ring 124 engages collet sleeve 88 and extends into the at least one groove 116 in lower housing portion 86 of first flapper valve housing 62. The at least one lock ring in the embodiment disclosed comprises a first pair of lock rings which comprises a first upper lock ring 126 and a first lower lock ring 128. In the first position 104 of collet sleeve 88 first upper lock ring 126 engages collet sleeve 88 and extends radially outwardly into first upper groove 120. First lower lock ring 128 engages collet sleeve 88 and extends radially outwardly into first lower groove 122. The first upper and lower lock rings 126 and 128 detachably connect collet sleeve 88 in housing 52 in the first position 104 thereof.

Lower housing portion 86 has a radially inwardly extending shoulder 132 below second portion 115. Shoulder 132 defines an inner diameter 134. Shoulder 132 will engage first collet sleeve 88 at the lower end thereof in the first position 104 to prevent the collet fingers 94 from moving outwardly prematurely. Thus, lower housing portion 86 will retain collet sleeve 88 in a restrained position.

Bore 112 of lower housing 86 extends radially outwardly from shoulder 132 and defines a first annular channel 138 so that when moved to its second position 108 collet sleeve 88 may deform and breakaway seat 98 may spread radially outwardly to allow tripping ball 70 to pass therethrough.

In operation once casing 20 has been lowered to a desired location in the well cementing can begin. Fluid may be displaced ahead of the cement 30 and pressure increased so that tripping ball 70 will engage and pass through retaining ring 66. Tripping ball 70 will be displaced downwardly until it engages breakaway seat 98. Pressure is applied thereabove until a sufficient force is reached to disengage first collet sleeve 88 from upper and lower lock rings 126 and 128. Lower lock ring 128 will be received in a groove in first collet sleeve 88 in the second position 108 thereof to prevent further downward movement of collet sleeve 88. Breakaway seat 98 will be deformed and will spread radially outwardly into annular channel 138 to allow tripping ball 70 to pass therethough. One-way flow in the downward direction through housing 52 and thus through float collar 40 is allowed, but upward flow is prevented. Cementing of casing string 20 can therefore be performed through flapper valve 58. In one embodiment more than one flapper valve may be utilized. The current disclosure includes a second flapper valve 60.

Flapper valve 60 is generally like flapper valve 58. Second flapper valve 60 comprises second flapper valve housing 162 which forms a part of outer housing 52. Second flapper valve housing 162 comprises an upper housing portion 182 and a lower housing portion 186. A flapper 180 is pivotally connected to upper housing portion 182 with a pivot pin 184 or other mechanism. Flapper 180 is biased with a spring or otherwise to move from the open position 202 to the closed position 206 which is shown in FIG. 6.

Lower housing portion 186 of second flapper valve 60 is connected to upper housing portion 182. Flapper 180 in the open position extends downwardly into lower housing portion 186 and is restrained in the open position by a second collet sleeve 188 that is detachably connected in housing 52 and more specifically in lower housing portion 186 of second flapper valve housing 162. Collet sleeve 188 has upper end 190 and lower end 192. Collet sleeve 188 has a plurality of collet fingers 194 with radially inward facing collet heads 196 at the lower end 192 of collet sleeve 188. Collet heads 196 define a breakaway seat 198 which may be referred to as a second breakaway seat 198. Breakaway seat 198 has a diameter 200 which is smaller than diameter 72 of tripping ball 70.

Figure 5:
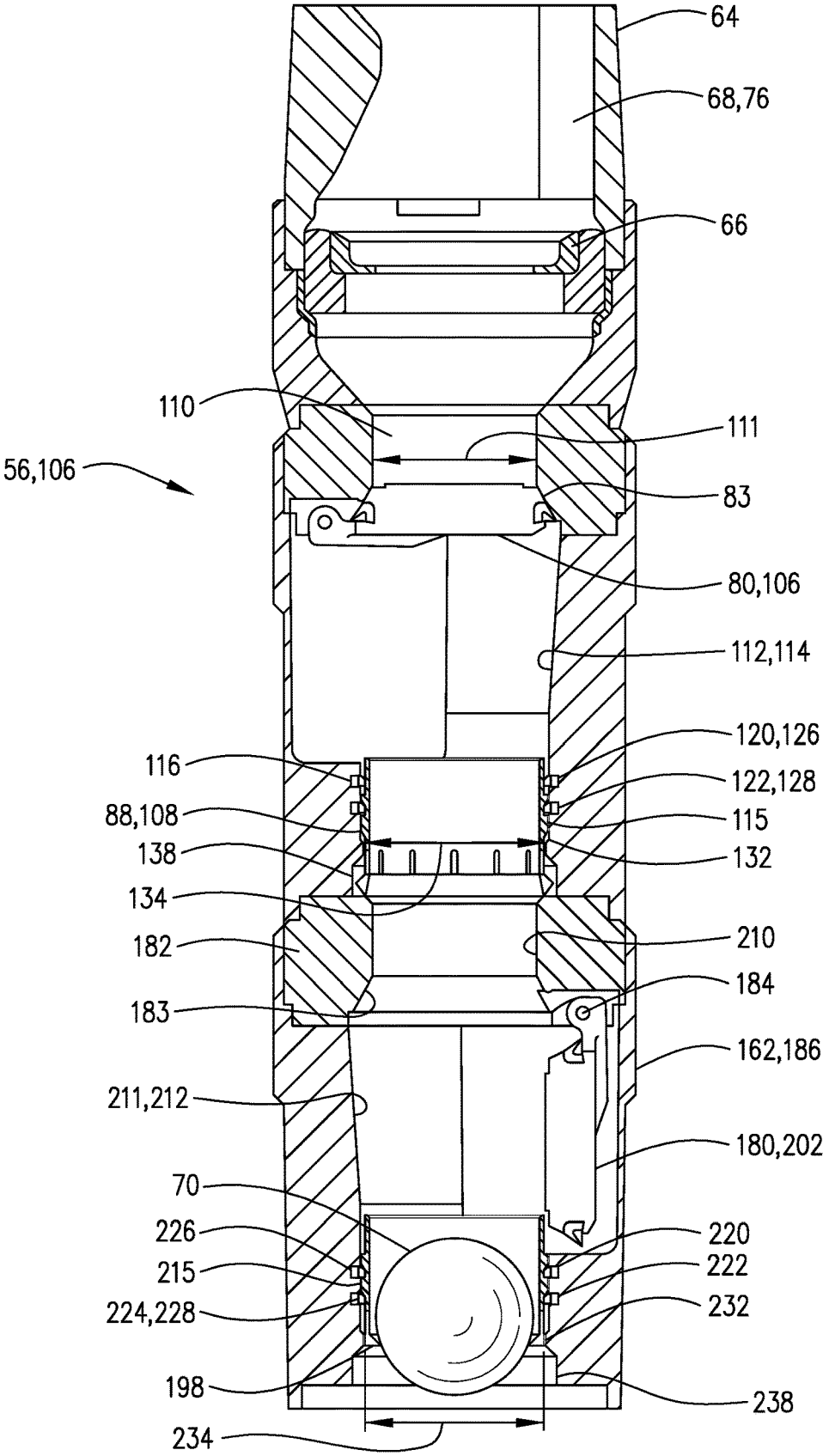
FIG. 5 is a cross-sectional view of a fill valve assembly with a first flapper in a closed position and the tripping ball engaging a second collet sleeve.
Figure 5:
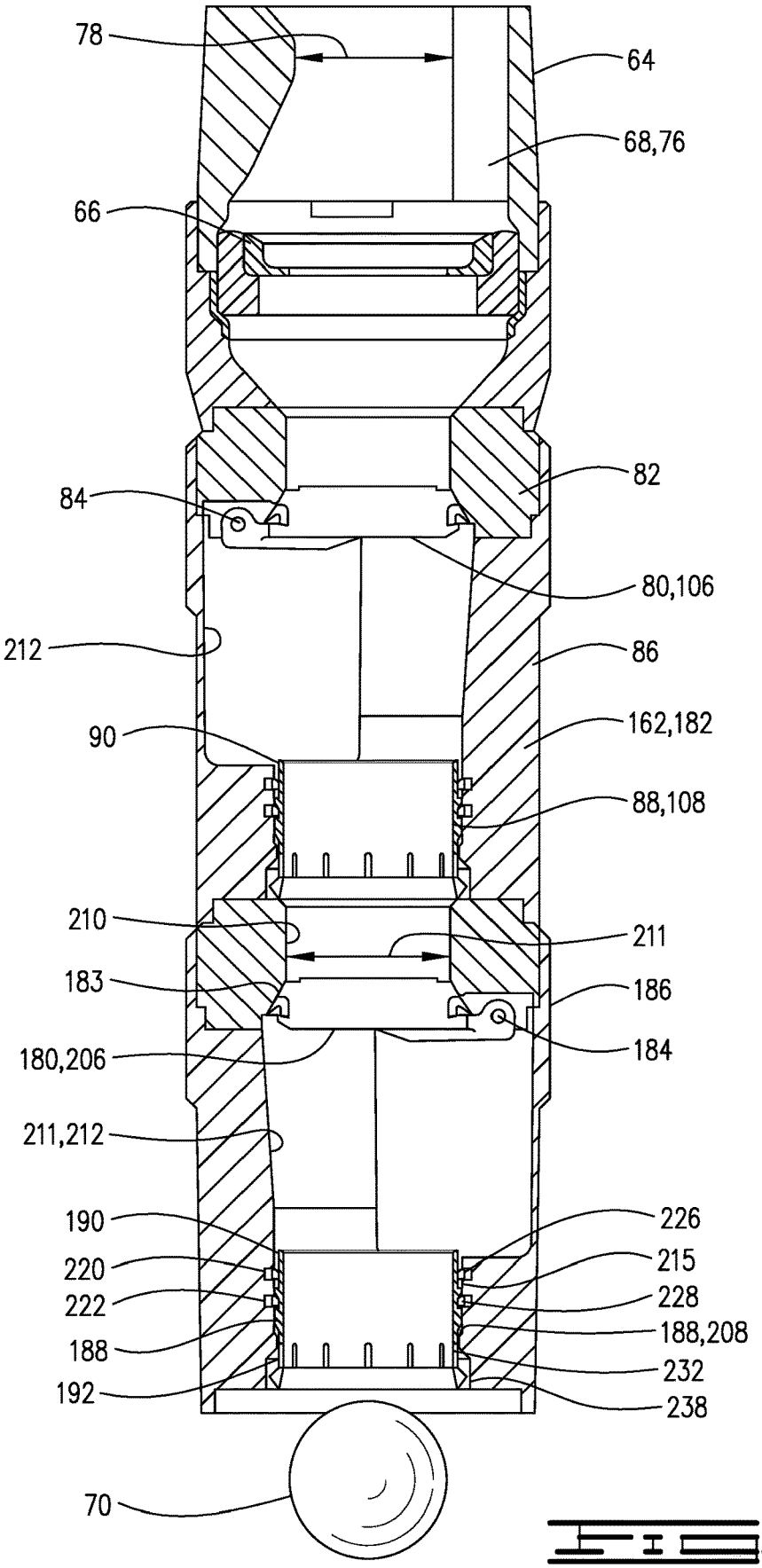

FIGS. 3-5 show the first position 204 of second collet sleeve 188 in which second collet sleeve 188 restrains flapper 180 in its open position 202. In the open position 202 two-way flow is permitted through the second flapper valve housing 162. The closed position 206 of flapper 180 is shown in FIG. 6. In the closed position 206 one-way flow only is allowed through second flapper valve 60. Thus, cement can flow downwardly therethrough but upward flow is prevented by flapper valve 60 and specifically by flapper 180 which is biased towards upper housing 182 in which the closed position 206 will engage a seat 183 defined on upper housing portion 182 to prevent upward flow therethrough. Flapper 180 moves to the closed position 206 when second collet sleeve 188 is detached from second flapper valve housing 162 and moves downwardly to its second position 208.

Upper housing portion 182 of second collet sleeve 188 has a bore 210 with a diameter 211 that is large enough to allow tripping ball 70 to pass therethrough. Housing 52 has a bore 212 and specifically lower housing portion 186 of second flapper valve housing 162 has a bore 212 that extends radially outwardly from bore 210. Bore 212 has a first portion 214 and a second portion 215 below first portion 214. Second portion 215 is a generally cylindrical portion. Second portion 215 has at least one groove 216 therein. The at least one groove 216 comprises a second pair of grooves 218. The second pair of second grooves 218 comprise a second upper groove 220 and a second lower groove 222.

At least one lock ring 224 engages collet sleeve 188 and extends into the at least one groove 216 in lower housing portion 186 of second flapper valve housing 162. The at least one lock ring 224 in the embodiment disclosed comprises a second pair of lock rings which comprises a second upper lock ring 226 and a second lower lock ring 228. In the first position 204 of collet sleeve 188 second upper lock ring 226 engages second collet sleeve 188 and extends radially outwardly into second upper groove 220. Second lower lock ring 228 engages collet sleeve 188 and extends radially outwardly into second lower groove 222. The second upper and lower lock rings 226 and 228 detachably connect collet sleeve 188 in housing 52 in the first position 204 thereof.

Lower housing portion 186 has a radially inwardly extending shoulder 232 below second portion 215. Shoulder 232 defines an inner diameter 234. Shoulder 232 will engage second collet sleeve 188 at the lower end 192 of collet sleeve 188 in the first position thereof to prevent the collet fingers 194 from moving outwardly prematurely. Thus, lower housing portion 186 will retain collet sleeve 188 in a restrained position. Bore 212 of lower housing 186 extends radially outwardly from shoulder 232 and defines a second annular channel 238 so that when moved to its second position 208 second collet sleeve 188 may deform and breakaway seat 198 may spread radially outwardly to allow tripping ball 70 to pass therethrough.

In operation once casing 20 has been lowered to a desired location in the well cementing can begin. Fluid may be displaced ahead of the cement 30 and pressure increased so that tripping ball 70 will engage and pass through retaining ring 66. As explained above, tripping ball 70 will be displaced downwardly until it engages breakaway seat 98 and moves collet sleeve 88 to its second position 108, which allows flapper 80 to move to its closed position 106. Tripping ball 70 will then engage breakaway seat 198 on second collet sleeve 188. Pressure is applied thereabove until a sufficient force is reached to disengage upper and lower lock rings 226 and 228 from second collet sleeve 188. Collet sleeve 188 will move downwardly to its second position 208 and flapper 180 will move to the closed position 106. Lower lock ring 228 will be received in a groove in second collet sleeve 188 in the second position 208 thereof to prevent further downward movement of collet sleeve 88. Breakaway seat 198 will be deformed and will spread radially outwardly to allow tripping ball 70 to pass therethough. One-way flow in the downward direction through housing 52 and thus through float collar 40 is allowed, but upward flow is prevented. Cementing of casing string 20 can therefore be performed through flapper valve 60.

Embodiments disclosed herein include:

A. A valve assembly comprising a valve housing defining a flow passage therethrough; a first flapper moveable from an open position in the valve housing in which two-way flow is allowed to a closed position in which only one-way flow through the valve housing is permitted; a first collet sleeve moveable from a first position to a second position in the valve housing, the first collet sleeve in the first position retaining the flapper valve in the open position; a breakaway seat at a lower end of the first collet sleeve for receiving a tripping ball; at least one lock ring engaging the first collet sleeve and extending into a groove in the valve housing, the lock ring configured to maintain the first collet sleeve in the first position until a tripping ball is engaged with the breakaway seat and a predetermined first force is applied to move the first collet sleeve from the first to the second position.

B. A valve assembly comprising a first flapper in a valve housing; a first collet sleeve in the valve housing, the first collet sleeve having a first position in the valve housing retaining the first flapper in an open position; a second flapper in the valve housing; a second collet sleeve in the valve housing, the second collet sleeve having a first position in the valve housing retaining the second flapper in an open position, wherein two-way flow is allowed through the valve housing when the first and second flappers are in the open position.

C. A valve assembly comprising a casing; a valve housing connected in the casing; a first flapper positioned in the valve housing and restrained in an open position by a first collet sleeve detachably connected in the valve housing; a second flapper positioned in the valve housing below the first flapper and restrained in an open position by a second collet sleeve detachably connected in the valve housing.

Each of the embodiments A, B and C may have one or more of the following additional elements in combination:

At least one lock ring comprising a first upper lock ring and a first lower lock ring, the first upper and lower lock rings engaging the first collet sleeve and extending into first upper and lower grooves in the valve housing in the first position of the collet sleeve.

A breakaway seat in a second collet sleeve for receiving the tripping ball after the first collet sleeve has moved to its second position and a breakaway force has been applied to the breakaway seat in the first collet sleeve.

A second upper lock ring engaging the second collet sleeve and extending into a second upper groove in the valve housing; and a second lower lock ring engaging the second collet sleeve and extending into a second lower groove in the valve housing.

Thus it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention.

What is claimed is:

1. A valve assembly comprising:

a valve housing defining a flow passage therethrough;

a first flapper moveable from an open position in the housing in which two-way flow is allowed to a closed position in which only one-way flow through the valve housing is permitted;

a first collet sleeve moveable from a first position to a second position in the housing, the first collet sleeve in the first position retaining the flapper valve in the open position;

a first deformable breakaway seat at a lower end of the first collet sleeve for receiving a tripping ball, the housing defining a radially extending shoulder that engages the first deformable breakaway seat in the first position of the first collet sleeve to prevent the first deformable breakaway seat from expanding radially outwardly until the first collet sleeve has moved out of its first position; and at least one lock ring engaging the first collet sleeve and extending into a groove in the valve housing, the at least one lock ring configured to maintain the first collet sleeve in the first position until the tripping ball is engaged with the first breakaway seat and a predetermined first force is applied to move the first collet sleeve from the first to the second position.

2. The valve assembly of claim 1, the at least one lock ring comprising a first upper lock ring and a first lower lock ring, the first upper and lower lock rings engaging the first collet sleeve and extending into first upper and lower grooves in the valve housing in the first position of the collet sleeve.

3. The valve assembly of claim 2 further comprising:

a second flapper positioned in the valve housing below the first collet sleeve, the second flapper moveable from an open position in which two-way flow is allowed through the housing to a closed position in which only one-way flow through the housing is permitted;

a second collet sleeve moveable from a first position to a second position in the valve housing, the second collet sleeve in the first position retaining the second flapper in the open position; and a second deformable breakaway seat at a lower end of the second collet sleeve for receiving the tripping ball, the housing defining a second radially extending shoulder that engages the second deformable breakaway seat in the first position of the second collet sleeve to prevent the second deformable breakaway seat from expanding radially outwardly until the second collet sleeve has moved out of its first position.

4. The valve assembly of claim 3, the first and second breakaway seats being deformed radially outwardly into first and second annular channels in the second positions of the first and second collet sleeves respectively.

5. The valve assembly of claim 3, wherein in the open position of the first and second flappers two-way flow through the housing is permitted and in the closed position of the first and second flappers upward flow is prevented and downward flow is permitted.

6. The valve assembly of claim 2, the first breakaway seat in the first collet sleeve configured to release the tripping ball to pass therethrough upon a breakaway force applied thereto as a result of fluid pressure in the housing above the tripping ball.

7. The valve assembly of claim 2, the tripping ball being trapped in a cage above the first flapper prior to being released to engage the first breakaway seat on the first collet sleeve.

8. A valve assembly comprising:

a first flapper in a valve housing;

a first collet sleeve in the valve housing, the first collet sleeve having a first position in the housing retaining the first flapper in an open position;

a first breakaway seat defined at a lower end of the first collet sleeve, the first breakaway seat being restrained from radially outward movement by the valve housing in the first position of the first collet sleeve;

a second flapper in the valve housing; and a second collet sleeve in the valve housing, the second collet sleeve having a first position in the valve housing retaining the second flapper in an open position, wherein two-way flow is allowed through the valve housing when the first and second flappers are in their respective open positions, a second breakaway seat defined at a lower end of the second collet sleeve, the second breakaway seat being restrained from radially outward movement by the valve housing in the first position of the second collet sleeve.

9. The valve assembly of claim 8, further comprising:

a first upper lock ring engaging the first collet sleeve and extending into a first upper groove in the valve housing;

a first lower lock ring engaging the first collet sleeve and extending into a first lower groove in the valve housing;

a second upper lock ring engaging the second collet sleeve and extending into a second upper groove in the valve housing; and a second lower lock ring engaging the second collet sleeve and extending into a second lower groove in the valve housing.

10. The valve assembly of claim 8, further comprising:

a tripping ball positioned above the first flapper, the tripping ball having a diameter greater than an inner diameter defined by the first breakaway seat at the lower end of the first collet sleeve and greater than an inner diameter defined by the second breakaway seat at the lower end of the second collet sleeve.

11. The valve assembly of claim 10, the first and second collet sleeves moveable from the first position of each to a second position of each, the first and second flappers moving to a closed position in which upward flow through the housing is prevented upon the first and second collet sleeves moving their second positions.

12. The valve assembly of claim 11, wherein the first lower lock ring extends into a groove in the first collet sleeve in the second position of the first collet sleeve and the second lower lock ring extends into a groove in the second collet sleeve in the second position of the second collet sleeve.

13. The valve assembly of claim 10, wherein the tripping ball engages the first breakaway seat in the first collet sleeve and moves the first collet sleeve to the second position as a result of a force applied by the tripping ball and wherein the first breakaway seat in the first collet sleeve spreads radially outwardly into a first annular channel in the second position of the first collet sleeve and allows the tripping ball to pass therethrough into the second collet sleeve to engage the second breakaway seat in the second collet sleeve.

14. The valve assembly of claim 13, wherein the tripping ball moves the second collet sleeve to the second position as a result to the force applied to the second breakaway seat by the tripping ball in the second collet sleeve, and wherein the second breakaway seat in the second collet sleeve spreads radially outwardly into a second annular channel in the second position of the second collet sleeve to allow the tripping ball to pass therethrough.

15. A valve assembly comprising:

a casing;

a valve housing connected in the casing, the valve housing defining first and second radially inwardly extending shoulders in a bore thereof;

a first flapper positioned in the valve housing and restrained in an open position by a first collet sleeve detachably connected in the valve housing;

a first deformable breakaway seat defined at a lower end of the first collet sleeve, wherein the first radially extending shoulder engages the first deformable breakaway seat to prevent the first deformable breakaway seat from expanding radially outwardly in a first position of the first collet sleeve;

a second flapper positioned in the valve housing below the first flapper and restrained in an open position by a second collet sleeve detachably connected in the valve housing; and a second deformable breakaway seat defined at a lower end of the second collet sleeve, wherein the second radially extending shoulder engages the second deformable breakaway seat to prevent the second deformable breakaway seat from expanding radially outwardly in a first position of the second collet sleeve.

16. The valve assembly of claim 15 further comprising a tripping ball positioned above the first flapper, the tripping ball having an outer diameter larger than a diameter defined by the first and second breakaway seats defined at the lower ends of the first and second collet sleeves respectively.

17. The valve assembly of claim 16, wherein the tripping ball engages the first deformable breakaway seat in the first collet sleeve and applies a downward force to the first deformable breakaway seat to move the first collet sleeve to a second position thereof and thereafter passes into the second collet sleeve and applies a downward force to the second deformable breakaway seat to move the second collet sleeve to a second position thereof.

18. The valve assembly of claim 16, the tripping ball being trapped between the retaining ring and an upper cage until the casing has reached a desired location in the well.

19. The valve assembly of claim 15, the first and second collet sleeves moveable to second positions in the valve housing, wherein the first and second flappers are released from the open position and moved to a closed position when the first and second collet sleeves move to their respective second positions.

20. The valve assembly of claim 19, the first and second breakaway seats being deformed radially outwardly in the second positions of the first and second collet sleeves respectively.

* * * * *